US006598991B2

(12) United States Patent
Altman

(10) Patent No.: US 6,598,991 B2
(45) Date of Patent: Jul. 29, 2003

(54) MINIATURE FLASHLIGHT DEVICE

(75) Inventor: Peter Altman, Austin, TX (US)

(73) Assignee: Lumatec Industries, Inc., Austin, TX (US)

( * ) Notice: Subject to any disclaimer, the term of this patent is extended or adjusted under 35 U.S.C. 154(b) by 0 days.

(21) Appl. No.: 09/758,923

(22) Filed: Jan. 10, 2001

(65) Prior Publication Data

US 2002/0089848 A1 Jul. 11, 2002

(51) Int. Cl.[7] ..... F21V 33/00

(52) U.S. Cl. ..... 362/116; 362/208; 362/105; 362/106; 362/189

(58) Field of Search ..... 362/105, 106, 362/116, 189, 208

(56) References Cited

U.S. PATENT DOCUMENTS

| | | | | | |
|---|---|---|---|---|---|
| 1,096,726 | A | * | 5/1914 | Knopf | 340/321 |
| 1,327,017 | A | * | 1/1920 | Bolthauser | 362/196 |
| 1,365,636 | A | * | 1/1921 | Bolthauser | 362/196 |
| 2,114,266 | A | * | 4/1938 | Bodor | 24/3.6 |
| D155,094 | S | * | 9/1949 | Lewis | D21/611 |
| D160,795 | S | * | 11/1950 | Levinson | D21/616 |
| 2,593,942 | A | * | 4/1952 | Van Vliet et al. | 362/112 |
| D173,704 | S | * | 12/1954 | Klotz | D19/42 |
| D194,550 | S | * | 2/1963 | Margolis | D21/506 |
| D197,114 | S | * | 12/1963 | Brody | D2/741 |
| 3,359,411 | A | | 12/1967 | Schwartz | 240/6.4 |
| 4,085,315 | A | | 4/1978 | Wolter et al. | 362/116 |
| 4,521,833 | A | | 6/1985 | Wolter | 362/116 |
| D287,058 | S | * | 12/1986 | Silverman | D21/560 |
| 4,628,418 | A | * | 12/1986 | Chabria | 224/903 |
| 4,644,451 | A | | 2/1987 | Chabria | 362/189 |
| D293,287 | S | * | 12/1987 | Cauque et al. | D10/31 |
| 4,881,155 | A | * | 11/1989 | Gahagan | 362/191 |
| 5,158,356 | A | | 10/1992 | Guthrie | 362/188 |
| 5,299,108 | A | * | 3/1994 | Griffin | 362/189 |
| D360,482 | S | * | 7/1995 | Freund | D11/157 |
| 5,434,761 | A | * | 7/1995 | Lesnick et al. | 362/189 |
| D390,983 | S | * | 2/1998 | Petruzzi | D26/38 |
| D393,730 | S | * | 4/1998 | Petruzzi | D26/38 |
| D400,326 | S | * | 10/1998 | Fisher | D26/38 |
| D404,155 | S | * | 1/1999 | Maddox | D26/37 |
| 5,893,631 | A | | 4/1999 | Padden | 362/201 |
| D425,227 | S | * | 5/2000 | Petruzzi | D26/38 |
| D427,699 | S | * | 7/2000 | Fai | D26/47 |
| D441,109 | S | * | 4/2001 | Suzuki | D26/38 |
| D442,305 | S | * | 5/2001 | Warden | D26/38 |
| D442,714 | S | * | 5/2001 | Warden | D26/38 |
| D445,518 | S | * | 7/2001 | Warden | D26/38 |

FOREIGN PATENT DOCUMENTS

| | | | |
|---|---|---|---|
| FR | 1443787 | 12/1966 | 362/200 |

* cited by examiner

*Primary Examiner*—Sandra O'Shea
*Assistant Examiner*—Ismael Negron
(74) *Attorney, Agent, or Firm*—Flanagan & Flanagan; John R. Flanagan

(57) ABSTRACT

A miniature flashlight device includes a housing having a cavity, a pair of magnets mounted to the housing, and a light generating assembly disposed in the cavity of the housing. The light generating assembly includes a lamp, at least one battery and a spring-loaded switch connected in an electrical circuit with the lamp and battery and activatable to electrically connect and disconnect the battery with the lamp. The magnets are arranged such that when the housing is placed on a ferromagnetic surface the magnets attract the surface with sufficient force to activate the spring-loaded switch and open the circuit, turning the device off. When the magnets are disengaged from the surface, the spring brings the switch into the closed circuit position.

4 Claims, 6 Drawing Sheets

MINIATURE FLASHLIGHT DEVICE

BACKGROUND OF THE INVENTION

1. Field of the Invention

The present invention generally relates to portable lighting devices and, more particularly, is concerned with a miniature flashlight device.

2. Description of the Prior Art

Miniature flashlight devices which can be stored in a pocket or attached to a key chain are known in the prior art. Examples of such miniature flashlight devices are disclosed in U.S. Pat. No. 3,359,411 to Schwartz, U.S. Pat. No. 4,085,315 to Wolter et al., U.S. Pat. No. 4,521,833 to Wolter, U.S. Pat. No. 4,644,451 to Chabria, U.S. Pat. No. 5,158,356 to Guthrie, U.S. Pat. No. 5,893,631 to Padden and French Pat. No. 1,443,787 to Teisseire.

Some common components of miniature flashlight devices include a housing, a battery disposed in the housing, an electric lamp supported in the housing, electrically conductive contact members positioned in the housing and electrically interconnecting spaced contact portions of the lamp with spaced contact portions of the battery of respective positive and negative polarities, and an actuating element mounted on the housing and being movable for closing and opening an electrical circuit between the electrically conductive contact members, the battery and the lamp.

The housings of these devices have various configurations and constructions. However, a common theme of the housings as well as other components is that they are mostly utilitarian in character. Miniature flashlight devices are increasingly popular with consumers because of their utilitarian character. The inventor herein has perceived an innovative way to expand the attractiveness of miniature flashlight devices to consumers without sacrificing their utilitarian character.

SUMMARY OF THE INVENTION

The present invention provides a miniature flashlight device which combines the utilitarian features of a flashlight with the ornamental appearance of a common item of apparel, such being a hat. The specific embodiment of a hat whose ornamental appearance is incorporated in the device of the present invention is a helmet or hardhat such as worn commonly by construction and other workers.

Accordingly, the present invention is directed to a miniature flashlight device which comprises: (a) a housing shaped to simulate a hat, the housing including (i) a main portion simulating a crown of the hat having a bottom opening and a side with a hole defined therethrough, the main portion defining an interior cavity in communication with the bottom opening of the main portion and the hole in the side of the main portion, and (ii) an extension portion simulating a bill of the hat disposed exteriorly of and attached to the main portion such that the bill extends at least partially about the main portion adjacent to the bottom opening thereof and outwardly from the main portion; (b) a cover adapted to interfit with the housing so as to close the bottom opening of the main portion thereof; (c) means for detachably attaching the cover to the housing; and (d) a light generating assembly disposed in the cavity of the housing when the cover is attached to the housing, the light generating assembly including an electric lamp module supported on the housing through the hole in the side of the main portion of the housing such that the lamp module extends both exteriorly from the main portion of the housing and interiorly into the cavity of the main portion of the housing. The main and extension portions of the housing together define a continuous bottom rim on the housing encompassing the extension portion and the bottom opening of the main portion. The cover is adapted to interfit with the continuous bottom rim on the housing so as to underlie the main and extension portions and close the bottom opening of the main portion of the housing.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
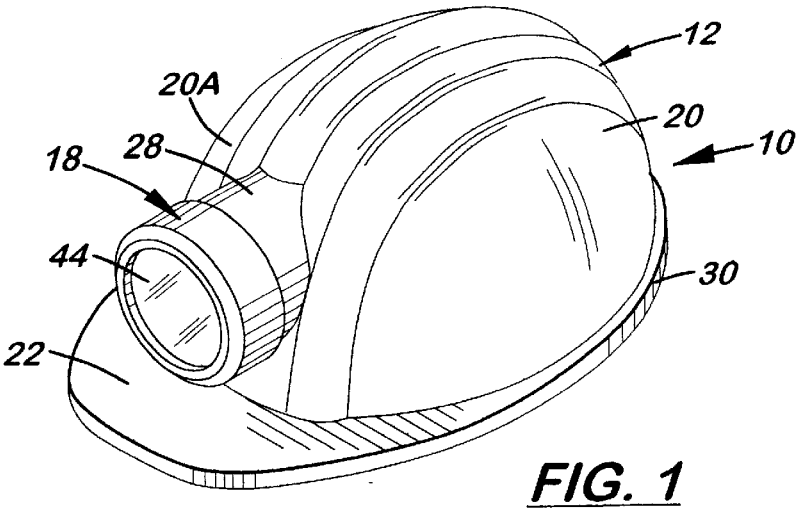
FIG. 1 is a perspective view of a first embodiment of a miniature flashlight device of the present invention.
Figure 2:
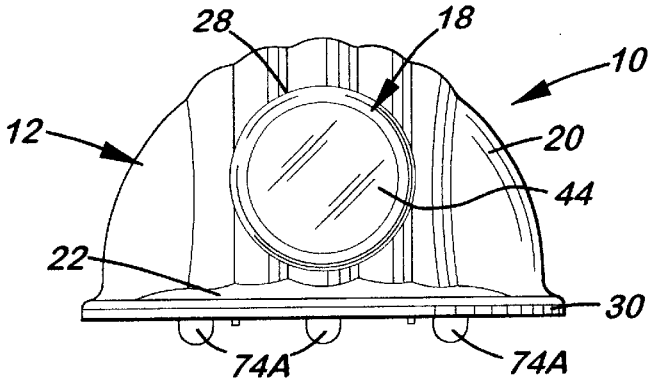
FIG. 2 is a front elevational view of the flashlight device of FIG. 1.
Figure 3:
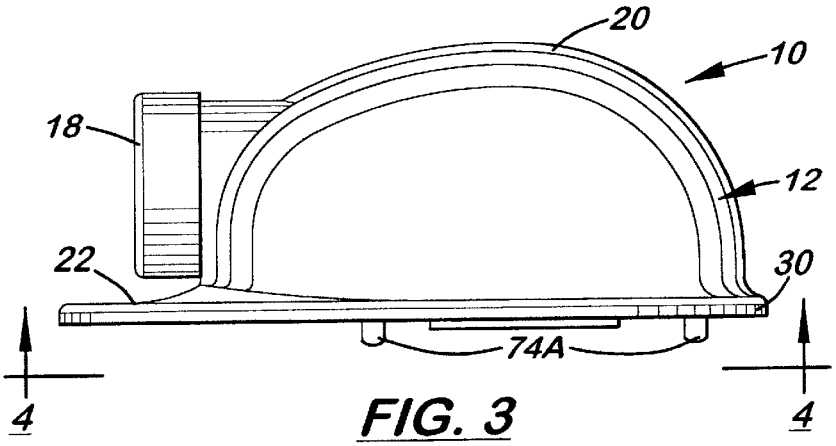
FIG. 3 is a side elevational view of the flashlight device of FIG. 1.
Figure 4:
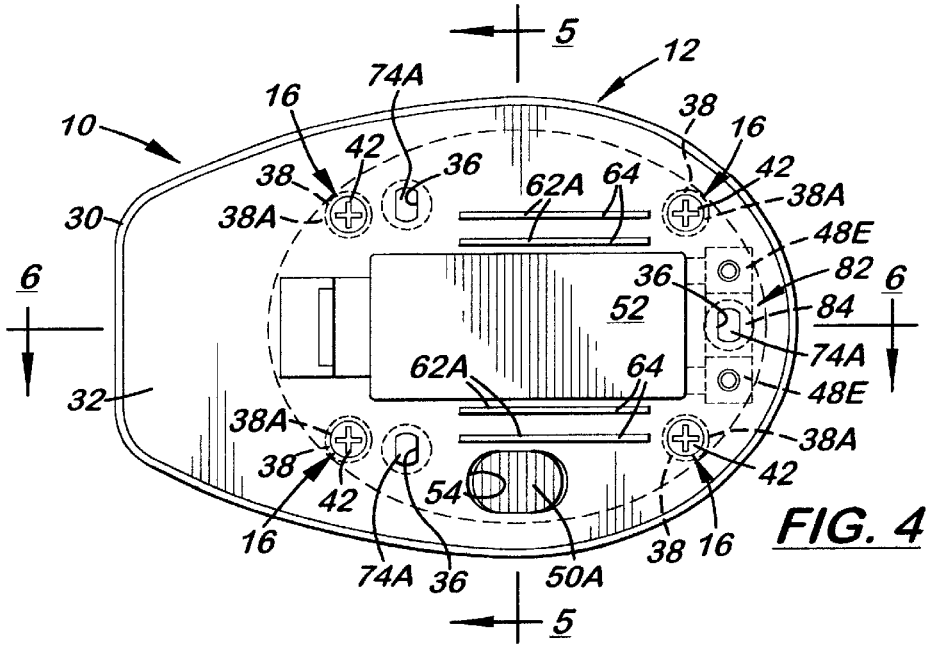
FIG. 4 is a bottom plan view of the flashlight device as seen along line 4—4 of FIG. 3.
Figure 5:
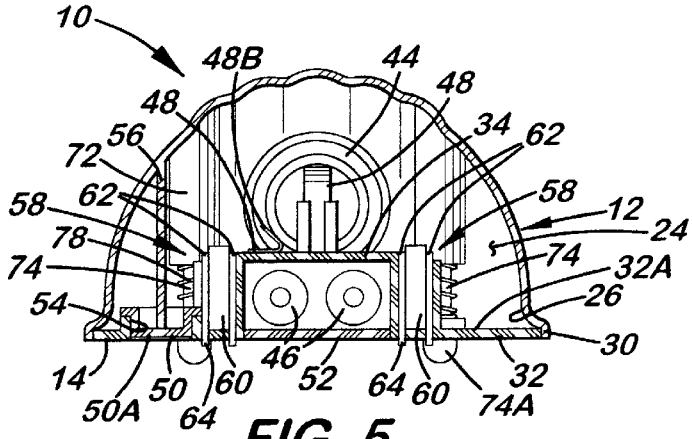
FIG. 5 is a transverse sectional view of the flashlight device taken along line 5—5 of FIG. 4.
Figure 6:
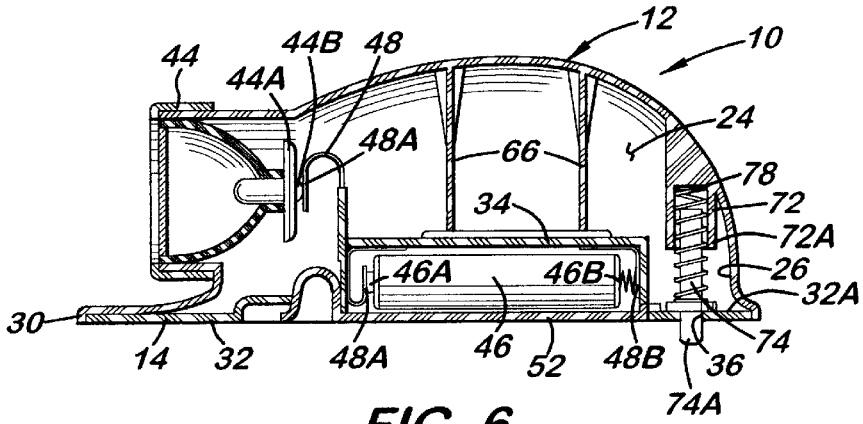
FIG. 6 is a longitudinal sectional view of the flashlight device taken along line 6—6 of FIG. 4.
Figure 7:
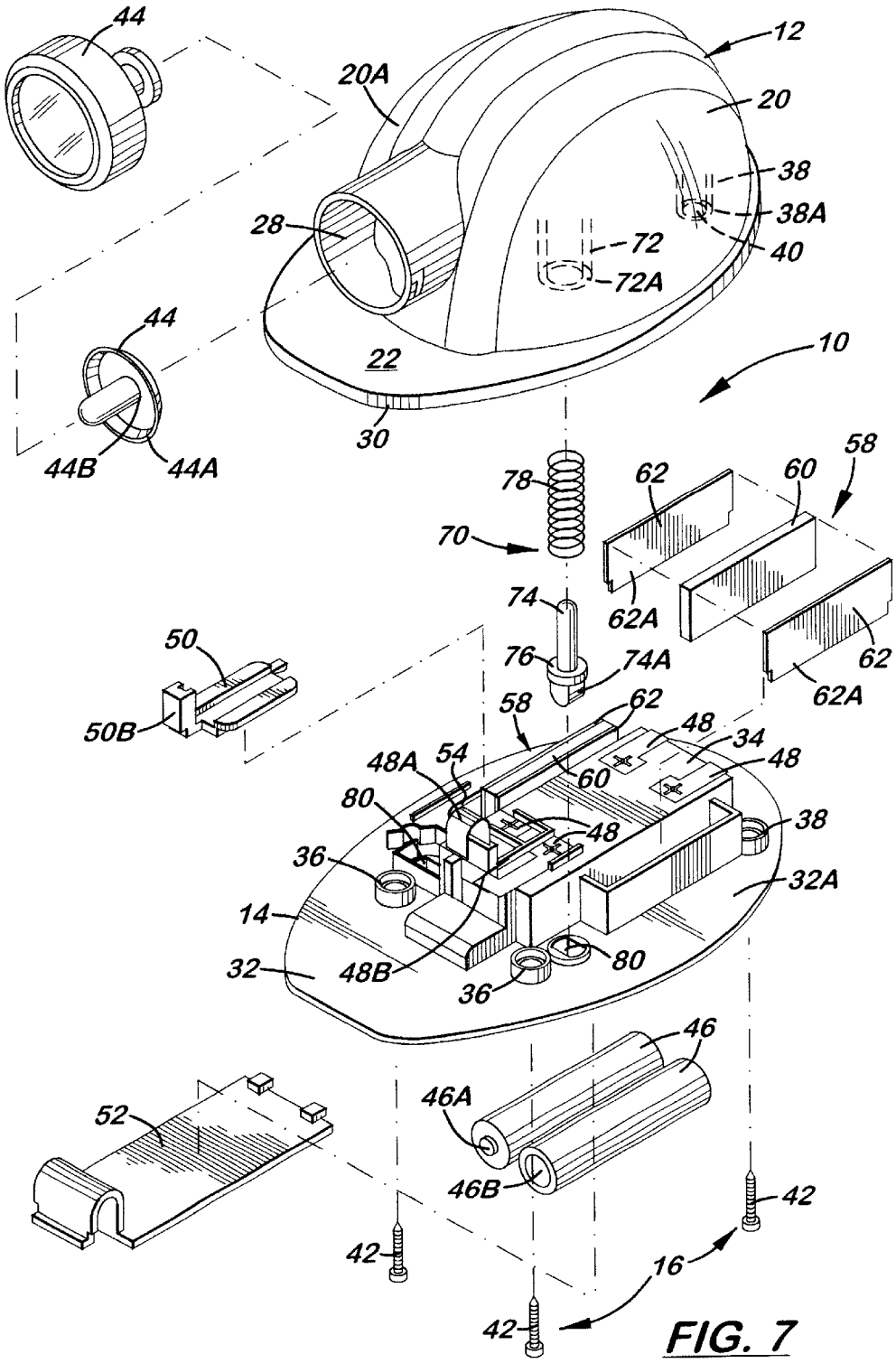
FIG. 7 is an exploded perspective view of the first embodiment of the flashlight device of FIG. 1.
Figure 8:
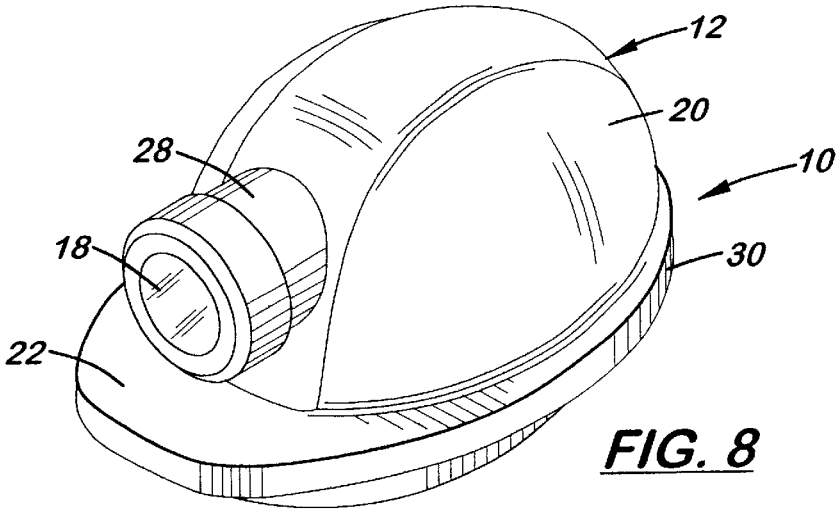
FIG. 8 is a perspective view of a second embodiment of a miniature flashlight device of the present invention.
Figure 9:
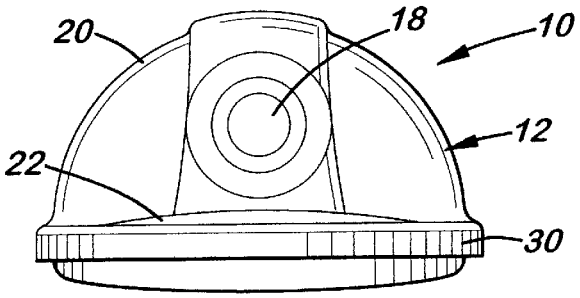
FIG. 9 is a front elevational view of the flashlight device of FIG. 8.
Figure 10:
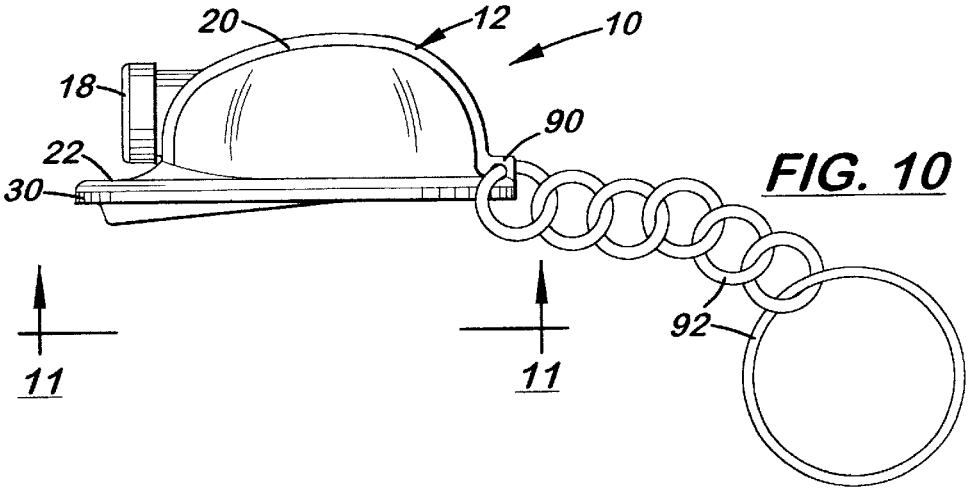
FIG. 10 is a side elevational view of the flashlight device of FIG. 8.
Figure 11:
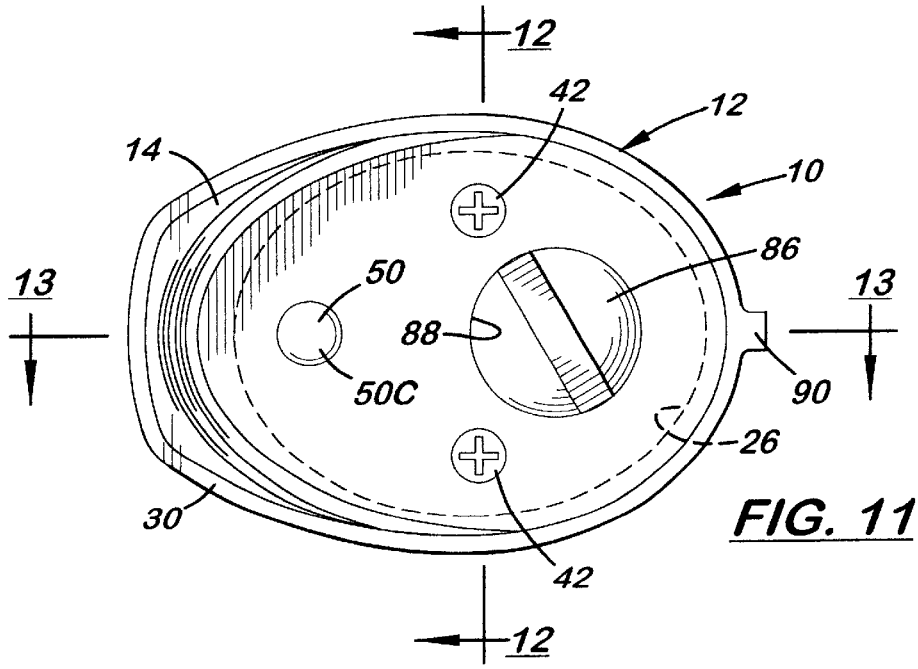
FIG. 11 is an enlarged bottom plan view of the flashlight device as seen along line 11—11 of FIG. 10.
Figure 12:
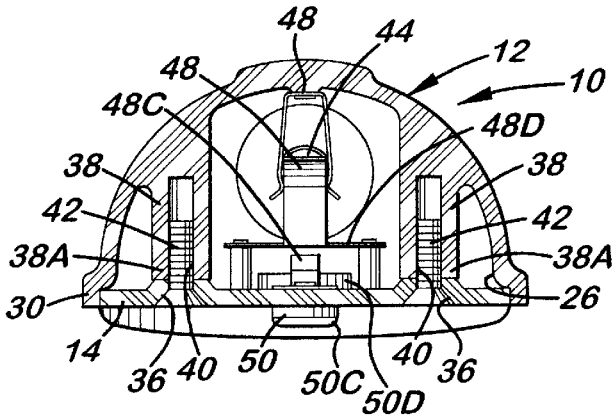
FIG. 12 is a transverse sectional view of the flashlight device taken along line 12—12 of FIG. 11.
Figure 13:
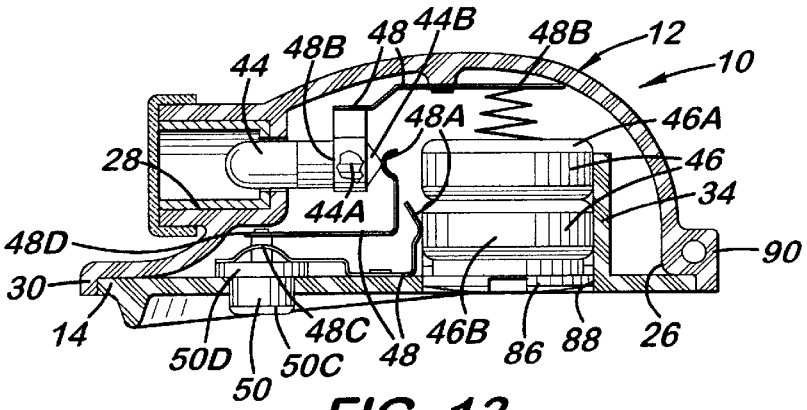
FIG. 13 is a longitudinal sectional view of the flashlight device taken along line 13—13 of FIG. 11.
Figure 14:
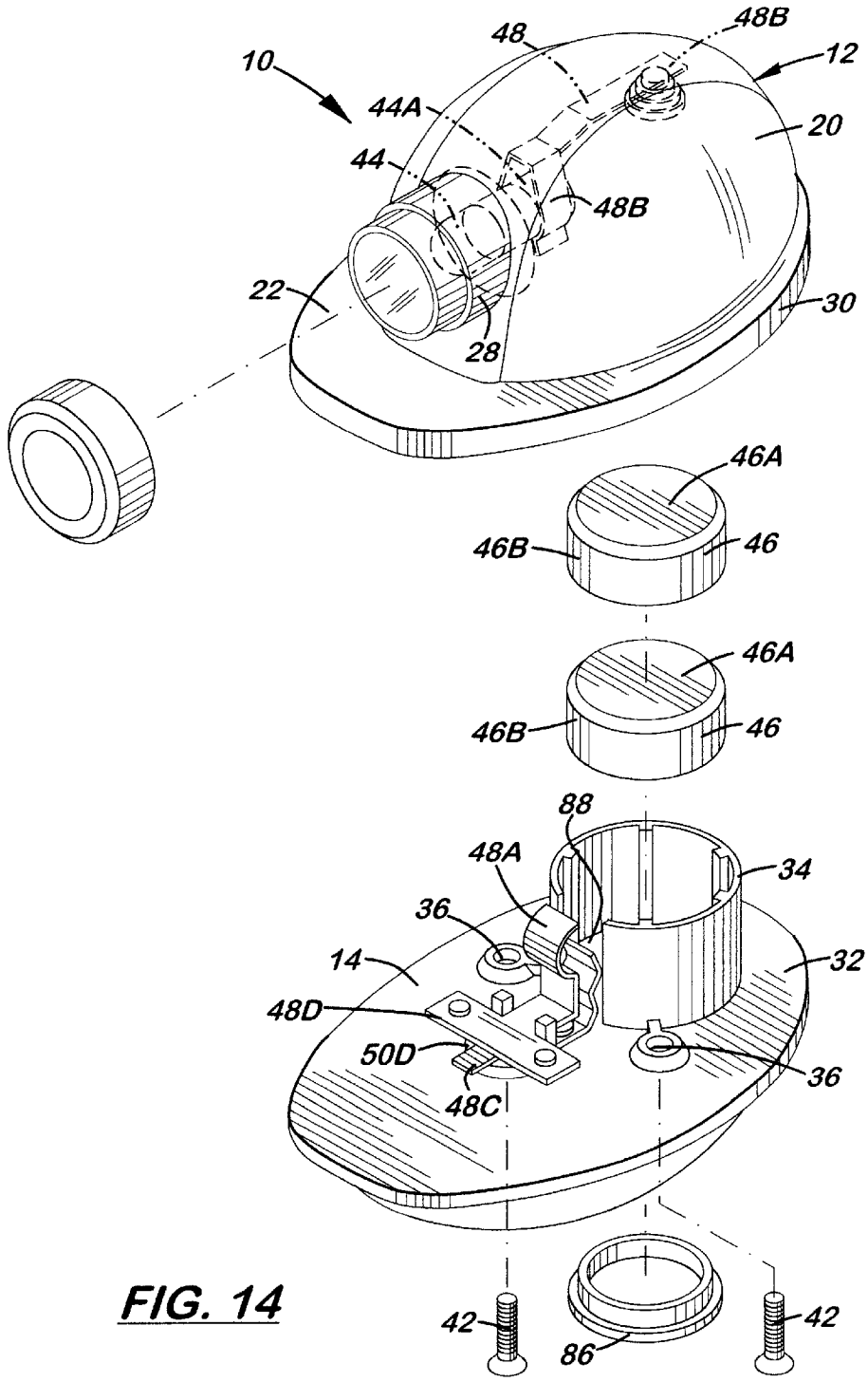
FIG. 14 is an enlarged exploded perspective view of the second embodiment of the flashlight device of FIG. 8.

Referring to the drawings, there is illustrated a miniature flashlight device, generally designated 10, of the present invention incorporating a hat-shaped configuration. A first embodiment of the miniature flashlight device 10 is illustrated in FIGS. 1 to 7 and a second embodiment of the miniature flashlight device 10 is illustrated in FIGS. 8 to 14. Basically, each of the embodiment of the miniature flashlight device 10 includes a housing 12 shaped to simulate a hat (or a cap and the like), a cover 14, fastening means 16 for detachably attaching the cover 14 to the housing 12, and a light generating assembly 18 disposed in the housing 12 when the cover 14 is attached thereto.

The housing 12 of the device 10 includes a main portion 20 simulating a crown of the hat and an extension portion 22 simulating a bill of the hat. The main portion 20 defines an interior cavity 24 and has a bottom opening 26 and a hole 28 which communicates with the cavity 24. The hole 28 is defined through a side 20A of the main portion 20. The side 20A of the main portion 20 containing the hole 28 preferably, but not necessarily, is a front side of the main portion 20. The extension portion 22 is disposed exteriorly of the main portion 20 and is rigidly attached to the main portion 20, preferably but not necessarily at the front side 20A of the main portion 20. The extension portion 22 is disposed adjacent to the bottom opening 26 such that the extension portion 22 extends outwardly from the main portion 20 below the hole 28 therein. The main and extension portions 20, 22 together have a continuous bottom rim 30 of generally oval configuration formed on and protruding from the housing 12 so as to encompass the extension portion 22 and the bottom opening 26 of the main portion 20. The cover 14 of the device 10 is in the form of a flat panel 32 of substantially oval configuration which interfits with the bottom rim 30 so as to underlie the main and extension portions 20, 22 and close the bottom opening 26 of the main portion 20. The flat panel 32 has a compartment 34 fixed on the inside surface 32A thereof for containing batteries. The fastening means 16 for detachably attaching the cover 14 to the housing 12 includes a plurality of apertures 36 defined in the flat panel 32 of the cover 14, a plurality of pedestals 38 rigidly fixed on and extending from the interior of the main portion 20 of the housing 12 through the cavity 24 to outer ends 38A having threaded holes 40 tapped therein, and a plurality of screws 42 insertable through the apertures 36 in the cover 14 and threadable into the threaded holes 40 of the pedestals 38.

The light generating assembly 18 of the device 10 is disposed in the cavity 24 of the housing 12 when the cover 20 is attached to the housing 12. The light generating assembly 18 includes an electric lamp module 44, one or more batteries 46, electrically conductive contact members 48, and a primary switch or actuating member 50. The electric lamp module 44 of the assembly 18 is supported on the housing 12 through the hole 28 in the front side 20A of the main portion 20 of the housing 12 such that the lamp module 44 extends both exteriorly from the main portion 20 of the housing 12 and interiorly into the cavity 24 of the main portion 20 of the housing 12. The lamp module 44 has spaced contact portions 44A, 44B disposed in the cavity 24 of the main portion 20 of the housing 12. The batteries 46 are received and contained in the compartment 34 on the cover 14 and thus are disposed in the cavity 24 of the housing 12 when the cover 14 is attached to the housing 12. The batteries 46 has electrical contact portions 46A, 46B of opposite polarity. The electrically conductive contact members 48 are attached and positioned on one or both of the compartment 34 on the cover 14 and on the main portion 20 of the housing 12. The contact members 48 electrically interconnect the spaced contact portions 44A, 44B of the lamp module 44 with the spaced contact portions 46A, 46B of the batteries 46. The actuating member 50 is mounted on the cover 14 and movable relative to the cover 14 between displaced positions to close and open an electrical circuit that is provided between the electrically conductive contact members 48 and the respective spaced contact portions 44A, 44B and 46A, 46B of the lamp module 44 and the batteries 46 engaged by the contact members 48.

Referring to FIGS. 1 to 7, in the first embodiment of the miniature flashlight device 10, the batteries 46 disposed in the battery compartment 34 and retained therein by a removable door 52 are of the elongated cylindrical types. The battery compartment 34 is of rectangular configuration. The actuating member 50 is disposed on the cover 14 and has a pad portion 50A extending through a slot 54 in the cover 14 for engagement by a finger of the user to slidably move the actuating member 50 back and forth along the slot 54 toward and away from spaced apart portions 48A of the contact members 48. A guide tab 56 is rigidly attached to the interior side of the main portion 20 of the housing 12 and extends downward to a lower edge 56A which restrains the actuating member 50 to only undergo the back and forth movement along the slot 54. With movement of the actuating member 50 toward the contact members 48, a leading end 50B of the actuating member 50 engages one of the portions 48A and forces into contact with the other of the portions 48A so as to complete the electrical circuit.

The first embodiment of the miniature flashlight device 10 also includes a pair of magnet assemblies 58 disposed along opposite longitudinal sides of the battery compartment 34. Each magnet assembly 58 includes a permanent magnet 60 and a pair of ferromagnetic plates 62 disposed along opposite sides of the permanent magnet 60 and aligned with narrow slits 64 in the cover 14 such that lower edges 62A of the plates 62 extend through the slits 64 and are exposed on the exterior side of the cover 14. The housing 12 has a pair of transverse strips 66 disposed within the cavity 24 and extending between and fixed to opposite lateral sides of the main portion 20 of the housing 12 so as to provide a pair of stops for holding the magnet assemblies 58 in their positions along the opposite longitudinal sides of the battery compartment 34.

The first embodiment of the miniature flashlight device 10 further includes telescoping guide elements 70 in the form of a plurality of spaced apart guide tubes 72 rigidly fixed on the interior side of the main portion 20 of the housing 12 and extending downward toward the cover 14, a plurality of posts 74 each slidably received in one of the guide tubes 72 and having collars 76 fixed thereabout near lower ends 74A of the posts 74, and a plurality of coil springs 78 each disposed over and about one of the posts 74 and extending between the collar 76 and an end 72A of the tube 72 so as to bias the posts 74 away from the tubes 72 and toward the cover 14. The cover 14 has openings 80 defined therethrough for receiving the ends 74A of the guide posts 74 extending outwardly from and below the collars 76. When the device 10 is placed on a surface of a structure made of ferromagnetic material, the magnet assemblies 58 function to attract and attach the device 10 at its cover 14 to and on the surface with sufficient force to overcome the biasing force of the coil springs 78 and cause retraction of the posts 74 into the tubes 72 and retraction the lower ends 74A of the posts 74 into the openings 80 of the cover 14.

One of the post 74 constitutes an auxiliary switch or actuating member 82. A contact segment 84 is disposed over and attached to the lower end 74A of the one post 74 and is movable from an engaged position to a disengaged position relative to auxiliary spaced portions 48B of the contact members 48 upon retraction of the lower end 74A of the one post 74 into one of the openings 80 in the cover 14 as caused by the magnetic attraction of the magnet assemblies 58 with the ferromagnetic structure. In the engaged position, the contact segment 84 overlaps and electrically interconnects the spaced portions 48E of the contact members 48 so as to complete the electrical circuit when the actuating member 50 is in the "on" position. In the disengaged position, the contact segment 84 is lifted off and disconnected from the spaced portions 48E of the contact members 48 so as to break the electrical circuit irrespective of whether the actuating member 50 is in the "on" or "off" position. Thus, with the actuating member 50 left in the "on" position, the lamp module 44 of the device 10 will remain turned off as long as the magnet assemblies 58 hold the device upon a ferromagnetic surface. Upon the device 10 being lifted from that surface, the lamp module 44 of the device 10 will be automatically turned on by the action of the auxiliary actuating member 82.

Referring to FIGS. 8 to 14, in the second embodiment of the miniature flashlight device 10, the actuating member 50 is disposed on the cover 14 and has a tip end 50C extending through a hole 84 in the cover 14 for engagement by a finger of the user to depress the actuating member 50 into the hole 84 to cause engagement of a spring contact portion 48C of one contact member 48 with a stationary contact portion 48D of the other contact member 48. The actuating member 50 has an inner head 50D on its opposite end which is larger in diameter than the hole 84. When the actuating member 48 is released, the spring contact portion 48C of the one contact member 48 forces the inner head 50D of the actuating member 50 into contact with the interior side of the cover 14 and the spring and stationary contact portions 48C, 48D away from one another The batteries 46 disposed in the compartment 34 on the inside of the cover 14 are of the disk-shaped types, also known as a button-cell battery. The battery compartment 34 is of cylindrical shape and has a button-shaped exterior door 86 which is removably insertable into an opening 88 to the compartment 34 to close off access thereto and retain the batteries 46 in the compartment. The second embodiment of the miniature flashlight device 10 also includes a loop 90 attached on a rear side of the housing 12 which receives a keychain 92.

It is thought that the present invention and many of its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A miniature flashlight device, comprising:

(a) a housing having a bottom opening, a hole defined through a side of said housing, an interior cavity defined in said housing in communication with said bottom opening of said housing and said hole in said side thereof, and a continuous bottom rim formed on said housing encompassing said bottom opening thereof;

(b) a cover adapted to interfit with said continuous bottom rim on said housing so as to underlie and close said bottom opening thereof;

(c) means for detachably attaching said cover to said housing;

(d) a light generating assembly disposed in said cavity of said housing when said cover is attached to said housing, said light generating assembly including (i) an electric lamp module supported on said housing through said hole in said side thereof such that said lamp module extends both exteriorly from and interiorly into said cavity of said housing, (ii) at least one battery disposed in said cavity of said housing when said cover is attached to said housing, and (iii) an electrical circuit extending between and interconnecting said electric lamp module and said battery and having electrically conductive spaced contact members; and (e) an actuatable mechanism convertable between "on" and "off" positions for completing and breaking said electrical circuit to correspondingly actuate and deactuate said lamp module of said light generating assembly, said actuatable mechanism including (i) at least one magnet disposed in said cavity when said cover is attached to said housing, (ii) a plurality of spaced apart guide tubes rigidly fixed on an interior side of said housing and extending toward said cover, (iii) a plurality of posts each slidably received in one of said guide tubes and having collars fixed thereabout and near outer ends of said posts which extend through openings in said cover, and (iv) a plurality of coil springs each disposed over and about one of said posts and extending between said collar and an end of said tube so as to bias said posts away from said tubes such that when said device is placed on a surface of a structure made of ferromagnetic material said magnet functions to attract and attach said device at said cover to and on the surface with sufficient force to overcome the biasing force of the coil springs and cause retraction of said posts into said tubes and said outer ends of said posts into said openings of said cover, (v) wherein one of said posts has a contact segment attached thereto and movable between engaged and disengaged positions relative to said electrically conductive spaced contact members of said electrical circuit of said light generating assembly upon extension and retraction of said one post from and into said cover such that said one post and said contact segment thereon constitutes a switch that completes the electrical circuit when said actuatable mechanism is in said "on" position and said contact segment is in said engaged position with said contact members and breaks the electrical circuit when said actuatable mechanism is in said "off" position and said contact segment is in said disengaged position with said contact members.

2. The device of claim 1 wherein said electric lamp module has spaced contact portions disposed in said cavity of said housing.

3. The device of claim 2 wherein said electrically conductive contact members are positioned on said cover and in said cavity and one said housing and electrically interconnect said spaced contact portions of said lamp module with contact portions of said battery of opposite polarity.

4. The device of claim 3 further comprising:

an actuating member mounted on said cover and being movable for closing and opening said electrical circuit between said electrically conductive contact members and said contact portions of said battery and lamp module.

* * * * *